United States Patent [19]

Kelly

[11] Patent Number: 4,505,142

[45] Date of Patent: Mar. 19, 1985

[54] FLEXIBLE HIGH PRESSURE CONDUIT AND HYDRAULIC TOOL FOR SWAGING

[75] Inventor: John W. Kelly, La Canada, Calif.

[73] Assignee: Haskel, Inc., Burbank, Calif.

[21] Appl. No.: 522,518

[22] Filed: Aug. 12, 1983

[51] Int. Cl.[3] ..... B21D 22/10

[52] U.S. Cl. ..... 72/54; 29/421 R

[58] Field of Search ..... 72/54, 58–61; 29/421 R

[56] References Cited

U.S. PATENT DOCUMENTS

| | | | |
|---|---|---|---|
| 3,729,966 | 5/1973 | Khoury | 72/54 |
| 3,992,912 | 11/1976 | Jonssen | 72/54 |
| 4,006,619 | 2/1977 | Andersen | 72/54 |
| 4,121,442 | 10/1978 | Brooks | 72/54 |
| 4,359,811 | 11/1982 | Monroe | 29/421 R |
| 4,362,324 | 12/1982 | Kelly . | |
| 4,419,876 | 12/1983 | Sparel | 72/60 |

*Primary Examiner*—Leon Gilden

*Attorney, Agent, or Firm*—Pretty, Schroeder, Brueggemann & Clark

[57] ABSTRACT

A high pressure hydraulic tool such as a tube swaging apparatus having a lengthwise-flexible, hollow metallic delivery conduit extending from a hydraulic pressure source to an adaptor. The conduit has an outer diameter of less than about one-eighth inch and an inner diameter of from about 0.01 inch to about 0.05 inch, the conduit being fabricated from a metal having a tensile strength sufficiently great that the tube will not fail when pressurized to at least about 30,000 psi. Swivelable connectors join the lengthwise-flexible conduit to the hydraulic pressure source and to the adaptor, so that the hydraulic source may be connected readily to a succession of tubes to be swaged.

12 Claims, 4 Drawing Figures

FLEXIBLE HIGH PRESSURE CONDUIT AND HYDRAULIC TOOL FOR SWAGING

BACKGROUND OF THE INVENTION

The present invention relates to hydraulic swaging devices for radially expanding tubular structures, and, more particularly, to a high-pressure swaging device wherein an adaptor is connected to a hydraulic pressure source through a lengthwise-flexible metallic conduit.

There are a variety of situations in which it is desired to expand a metal tube radially to form a tight, leak-free joint with a surrounding structure. For example, large heat exchangers, particularly of the type used as steam generators in power plants, often employ a tube sheet, which is a steel plate up to several feet thick, through which hundreds of stainless steel or carbon steel tubes must pass. The tube sheet is initially fabricated with bores of a suitable diameter into which the tubes are inserted. The tubes are then expanded against the sides of the bores by internally pressurizing the tubes to a sufficiently high pressure that they are plastically expanded into sealing contact with the bores.

A preferred approach for accomplishing the expansion of the tubes is insertion of a mandrel into the tube, the mandrel being sufficiently long that it spans the entire thickness of the tube sheet. The mandrel is provided with seals at either end to confine fluid pressure within the space between the mandrel and the inside wall of the tube, and is further provided with an external fluid connection. A source of high hydraulic pressure, at least about 30,000 psi and typically about 60,000 psi, is attached to the external fluid connection, and the space between the mandrel wall and the inside of the tube is pressurized. This high pressure plastically deforms the wall of the tube outwardly into sealing contact with the bore of the tube sheet, thereby sealing the tube into place. The hydraulic pressure is then released, the mandrel is withdrawn, and the process is repeated with the next tube.

In a typical power plant heat exchanger, there may be one thousand or more tubes in each heat exchanger, and each tube must be sealed into a tube sheet at each of its ends. Thus, it is necessary to repeat the expansion process many times, and it is highly desirable that such expansion process be rapidly and conveniently performed. Moreover, in some instances the tubes and tube sheets are located inside other structure and are relatively inaccessible.

Experience has shown that conducting the necessarily high pressure to each of a series of tubes is one of the most difficult aspects of the expansion process. In one approach, the hydraulic pressure source is itself moved from tube to tube. This approach is generally unsatisfactory, since the hydraulic pressure source is large and clumsy, and may be quite heavy.

In another approach, described in U.S. Pat. No. 4,362,324, the hydraulic pressure source is stationary, and pressure is conducted to the mandrel by a jointed high pressure conduit wherein a series of rigid sections are connected together with a plurality of movable joints. Such a conduit generally performs satisfactorily, but has several drawbacks. A large number of joints are required, requiring the use of many machined pieces and many seals. This conduit is therefore relatively expensive to manufacure, and may be subject to leakage at any of the seals. The conduit also may not be usable when the tubes and tube sheets are located within a tightly constrained outer shell and access is through an opening in the shell, since the flexibility of the conduit is limited by the geometry of the rigid tube-like sections and the plurality of joints. Finally, the length of such a conduit is limited by practical considerations to about eight feet.

Although a jointed high-pressure conduit such as that disclosed in U.S. Pat. No. 4,362,324 is successful in connecting the pressure source to the mandrel for repetitive swaging of a succession of tubes, there exists a continuing need for a more flexible high-pressure conduit which provides the advantages of the jointed conduit and avoids its limitations and disadvantages. The present invention fills this need, and further provides related advantages.

SUMMARY OF THE INVENTION

The present invention relates to a conduit system for conveying fluid from a high-pressure hydraulic pressure source to an adaptor for connection to apparatus requiring high hydraulic pressures, wherein the conduit is made from a single length of lengthwise-flexible metallic tubing and a swivelable end connection is provided to increase the flexibility of the system. This arrangement allows a workman performing a sequence of operations requiring hydraulic pressure, such as the swaging of a series of tubes in a tube sheet, to perform the operations readily and without the need for extensively adjusting the conduit system between each operation. Since the conduit system has no intermediate joints, it is relatively inexpensive to produce, and reliable and easy to maintain during service. Moreover, the high degree of manual maneuverability of the system allows hydraulic operations to be performed in cramped work spaces remote from the pressure source. Accordingly, the productivity of workers performing such hydraulic operations is greatly enhanced.

In accordance with the invention, the conduit system includes a lengthwise-flexible, hollow delivery conduit having no joints therein, the conduit having an outer diameter of less than about one-eighth inch and an inner diameter of from about 0.01 inch to about 0.05 inch. The conduit is fabricated from a solid metal having a tensile strength sufficiently great that the conduit will not fail when pressurized to at least about 30,000 psi or greater, the pressure required for high-pressure hydraulic operations. The conduit is connected at its delivery end to an adaptor, using a swivelable connector allowing the angle between the conduit and the adaptor to change as required by the position adopted by the workman. The connection between the conduit and the hydraulic pressure source is desirably, but not necessarily, swivelable.

Preferably, the conduit is manufactured from work-hardened 304 stainless steel, which is found to be sufficiently strong to resist failure of the conduit under pressures greater than about 30,000 psi, allows sufficient lengthwise flexibility of the conduit, resists kinking, and is also resistant to corrosion when water is used as the pressurizing medium. The swivelable connectors are preferably rotational connectors allowing rotation of the conduit about its lengthwise axis at the point of connection. Such connectors are reliable and inexpensive to manufacture and require a minimum number of seals. Alternatively, more complex swivelable connectors may be utilized.

It will be appreciated from the foregoing that the present invention represents a significant advance in the hydraulic pressure-tool field. A conduit system in accordance with the invention allows a workman to readily perform a sequence of operations requiring movement to separate but adjacent points. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate a preferred embodiment of the invention. In such drawings.

DESCRIPTION OF THE PREFERRED EMBODIMENT

Figure 1:
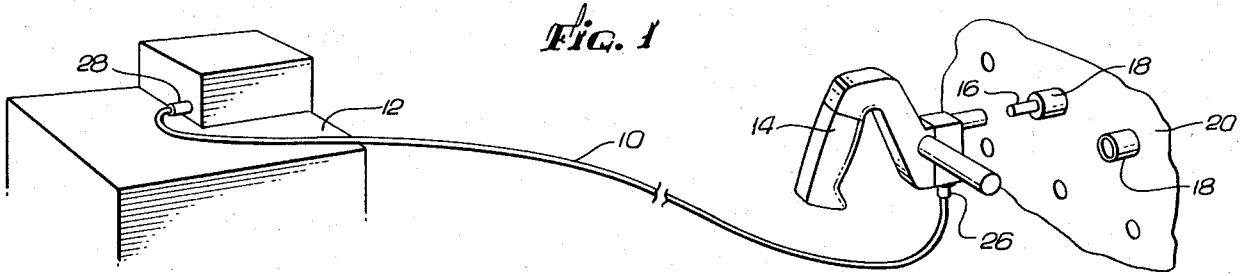
FIG. 1 is a perspective view of a hydraulic swaging tool in accordance with the invention having a pressure source, an adaptor, and a lengthwise-flexible conduit system, shown in relation to a tube sheet with tubes extending therefrom.

As is shown in the drawings with reference to a swaging tool for enlarging tubes extending through a tube sheet, a conduit system 10 provides hydraulic communication between a pressure source 12 and an adaptor 14. A pressure-transmitting fluid such as water or oil is pumped from the pressure source 12 through the conduit system 10 into the adaptor 14 and thence into a mandrel 16, and pressurized to a pressure of greater than about 30,000 psi by a pressure intensifier (not shown) located within the pressure source 12. The adaptor 14 is disconnectably attached to the mandrel 16, so that it may be readily moved to another mandrel 16.

In typical operation, the adaptor 14 is connected to the mandrel 16 inserted into a first tube 18, and the pressure source 12 is activated to pressurize the system to greater than about 30,000 psi, and typically about 60,000 psi, thereby causing the tube 18 to expand within a tube sheet 20 to effect a seal therebetween. Pressure is then released from the pressure source 12 and the pressurizing fluid flows out of the mandrel 16 back into the pressure source 12 through the conduit system 10. The workman then removes the adaptor 14 and the mandrel 16 from the tube 18 and repeats the operation at the next tube to be expanded.

Figure 2:
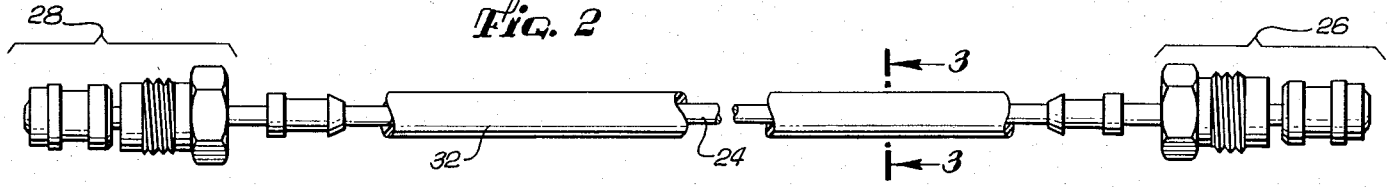
FIG. 2 is an enlarged, partially fragmented view of the conduit system of FIG. 1.
Figure 3:
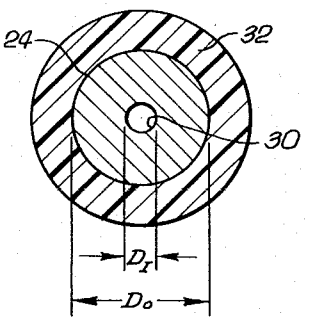
FIG. 3 is a transverse sectional view of a conduit, taken generally along line 3—3 of FIG. 2.

In accordance with the present invention and as illustrated in FIGS. 2 and 3, the conduit system 10 includes a lengthwise-flexible, hollow delivery conduit 24 with an adaptor connector 26 and a pressure-source connector 28 at the opposite ends thereof. The conduit 24 has an outer diameter $D_o$ of less than about one-eighth inch, and an inner diameter $D_i$ of an inner bore 30 of from about 0.01 inch to about 0.05 inch. The conduit 24 is fabricated from a solid metal having a tensile strength sufficiently great so that the conduit 24 will not fail when fluid in its inner bore 30 is pressurized to at least about 30,000 psi. Since each pressurizing operation requires fluid to flow from the pressure source 12 to the adaptor 14 through the conduit system 10, the inner bore 30 must be sufficiently large to allow a volume of fluid to be transmitted in a reasonable time. If the inner diameter $D_i$ is substantially less than about 0.02 inch, fluid transfer times become long, and are unacceptably long for inner diameters of less than about 0.01 inch. On the other hand, if the inner diameter $D_i$ is made greater than about 0.05 inch, it is found that the strength of the tube is insufficient to resist failure when pressurized to greater than about 30,000 psi. The outer diameter $D_o$ of the conduit 24 cannot be made substantially greater than about one-eighth inch if the conduit 24 is to retain sufficient lengthwise flexibility to be used in the intended manner. For example, a one-quarter inch outside diameter tube does not have sufficient lengthwise flexibility to allow the fluid injector 14 to be moved from tube to tube without moving the pressure source 12. A covering 32 may optionally be provided over the conduit 24 to protect the conduit 24 during use. Preferably, the covering 32 is a shrink-fit tubing such as polyolefin which may be applied to the conduit 24 before the connectors 26 and 28 are attached.

The preferred material of construction for the conduit 24 is work-hardened 304 stainless steel, for a preferred conduit 24 having an outer diameter $D_o$ of one-eighth inch and an inner diameter $D_i$ of 0.04 inch, most preferably 0.042 inch. This stainless steel tubing is drawn, annealed and final drawn to a "half hard" temper having a yield strength of from about 95,000 to about 125,000 psi. If the conduit 24 has other combinations of inner and outer diameters, other materials may be chosen, subject to the requirement that the conduit 24 withstand internal fluid pressures of greater than about 30,000 psi, and specifically must withstand the selected pressure. The calculation of the required material stength for a selected conduit size is well known in the art of designing hydraulic systems. A convenient length for the conduit 24 is found to be about eight feet, although greater lengths can be readily provided.

Figure 4:
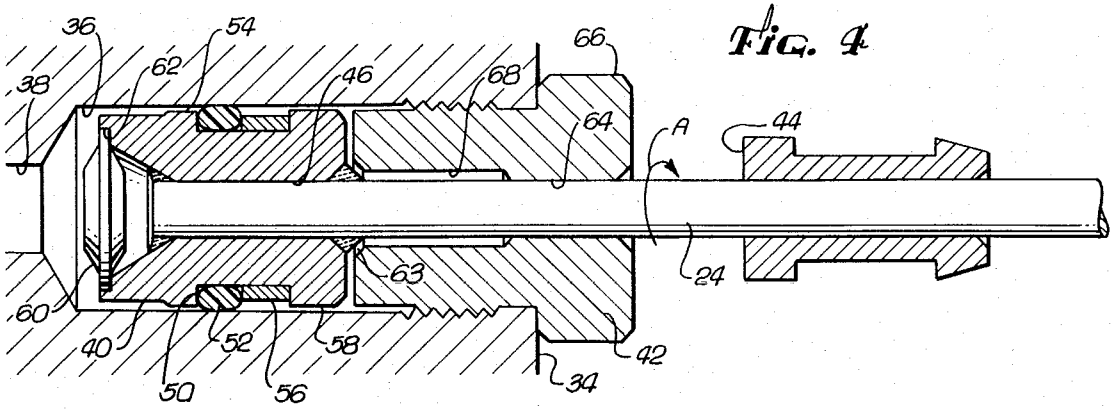
FIG. 4 is a further enlarged, sectional view of an assembled connector.

The conduit 24 is connected at each end to a receiver 34, which may be in either the pressure source 12 or the adaptor 14. As illustrated in FIG. 4, the receiver 34 includes a threaded bore 36 leading to a passageway 38. Hydraulic fluid flows from the conduit 24, through a portion of the threaded bore 36 into the passageway 38, and thence into the adaptor 14, for the illustrated connector 26 of the adaptor 14. Conversely, for the pressure source connector 28 at the other end of the conduit 24, fluid flows from the passageway into the conduit. The connectors 26 and 28 are substantially identical except as noted below, and for convenience only the connector 26 will be described in detail.

Referring to FIG. 4, the connector 26 includes a high-pressure end-fitting 40 received into the bore 36, and a threaded nut 42 engaging the corresponding threads in the threaded bore 36, to retain the high-pressure end-fitting 40 in the bore 36. A stop 44 is provided so that during disengagement the contact between the nut 42 and the stop 44 assists in the extraction of the high-pressure end-fiting 40 from the threaded bore 36.

The high-pressure end-fitting 40 is of generally cylindrical configuration and has a cylindrical end-fitting bore 46 extending axially therethrough. The outer diameter of the high-pressure end-fitting 40 is sized smaller than the inner diameter of the threaded bore 36 to provide a clearance between the outer diameter of the high-pressure end-fitting 40 and the inner diameter of the threaded bore 36. Preferably, the clearance is from about 0.0005 to about 0.002 inches. An annular seal slot 50 extends circumferentially around the outer diameter of the end-fitting 40 for receipt of sealing means. The preferred sealing means includes a rubber O-ring 52 on a high-pressure side 54 of the seal, and a circumferential polyurethane back-up ring 56 on a low-pressure side 58 of the seal.

In the adaptor connector 26, a disc filter 60 is provided to prevent residue from flowing from the mandrel 16 into the conduit 24 through the adaptor 14, when pressure is released and fluid back flows out of the mandrel 16. The filter 60 is positioned so that all fluid back flow passes through the filter 60, and most conveniently the filter 60 is transversely positioned in the high-pressure end-fitting 40. For this purpose, a filter cut-out 62 in the high-pressure end-fitting 40 is provided to receive the filter 60. Preferably, a 100 micron disc filter such as that available from Norman Equipment Company, Bridgeview, Illinois, is utilized. No filter 60 is necessary in the pressure-source connector 28, but one may optionally be provided. Other means such as a by-pass valve could also be used to prevent the flow of residue into the conduit 24.

The high-pressure end-fitting 40 must be joined to the conduit 24 in a manner so as to effect a fluid-tight seal at pressures of greater than about 30,000 psi. Preferably, the high pressure end-fitting 40 is joined by silver brazing to the end of the conduit 24 so that full contact and sealing is achieved over the entire length of the end-fitting bore 46, with a fillet 63. The disc filter 60 is welded about its entire circumference into the high-pressure end-fitting 40, to retain the filter 60 within the filter cut-out 62.

The nut 42 includes a bore of varying diameter extending therethrough. A nut inner bore 64 extends axially through a head 66 of the nut 42, and a coaxial long bore 68 extends through the remainder of the nut 42. The clearance between the nut inner bore 64 and the outer wall of the conduit 24 is preferably about 0.005 inch, and the clearance between the long bore 68 and the outer wall of the conduit 24 is preferably about 0.015 inch. The nut 42 is not joined to the conduit 24, but is instead free to slide and rotate thereon.

To assemble the described connector onto the conduit 24, the stop 44, the nut 42, and the high pressure end-fitting 40 are first loosely positioned in place in a fixture (not shown). The high-pressure end-fitting 40 is then silver brazed to the conduit 24, and then the stop 44 is soldered in place. The filter 60 is welded into the cut-out 62, and finally the rubber O-ring 52 and back-up ring 56 are inserted into the slot 50.

To connect the assembled connector to the receiver 34, the high-pressure end-fitting 40 is placed into the receiver bore 36 and forced inwardly against frictional contact between the rubber O-ring 52 and the threaded bore 36. The threads on the nut 42 are engaged to the corresponding threads in the receiver 34 and tightened. To disconnect, the nut 42 is loosened and then moved outwardly until it contacts the stop 44, thereby establishing a grip for withdrawing the high-pressure end-fitting 40 clear of the threaded bore 36.

With the connector fully engaged in the threaded bore 36, the receiver 34 may be rotated about the long axis of the conduit 24 in the direction indicated by the arrow A of FIG. 4. Such rotational freedom is particularly important at the adaptor connector 26, so that the adaptor 14 may be rotated in a 360° fashion about the conduit 24. While desirable, such rotational freedom is not necessary in the pressure-source connector 28. In cooperation with the lengthwise-flexibility of the conduit 24, the rotational freedom of movement of the connectors allows the adaptor 14 to be positioned and moved about with great freedom. An even greater freedom of movement could be provided by a fully swivelable or universal connector, but the achieving of greater freedom of movement is obtained at the expense of greater complexity, less reliability and greater cost of the connector. Further, testing has shown that the rotational connector allows sufficient overall system flexibility to achieve the intended purpose of the device. As used herein, then, the term "swivelable" indicates a connector having at least one degree of angular or rotational freedom of movement, and the preferred rotational connector is one such swivelable connector.

A pressure tool made in accordance with the present invention is utilized in a fashion generally as described previously. The pressure source 12 is placed at a central location, and the adaptor 14 is then used to swage a succession of tubes 18. The conduit system 10 and adaptor 14 are sufficiently light in weight that one workman may ordinarily accomplish the swaging procedures. In a typical case wherein the conduit 24 has an inner diameter $D_i$ of about 0.042 inch, about ½ second is required to build pressure from 0 to about 60,000 psi in the mandrel 16, after which the pressure is maintained for about 3 seconds to allow the expansion of the tube under the effect of the applied pressure. The pressure is then released and the fluid back flows from the mandrel 16, with any residue prevented from entering the conduit 24 by the filter 60. In prior devices utilizing conduits of larger internal diameter, filters were not necessary because the residue could not readily block or impede flow in the conduit. With the reduced diameter necessary to obtain the desired lengthwise flexibility of the conduit 24, the filter 60 is necessary inasmuch as previously tolerable particles may block the smaller inner diameter of the conduit.

The flexible conduit system of the present invention allows a significant improvement in the scope and convenience of operation of hydraulic tools such as swaging devices. The pressure source may be placed remotely from the mandrel, and a line of sight between the two is not necessary. Thus, if the tube sheet is enclosed by a housing or container having a small access opening therethrough, as is often the case, the pressure source may be placed outside the housing and the conduit extended through the opening in the housing. While such an approach was possible under limited circumstances using a jointed conduit, the jointed conduit system did not provide sufficient flexibility to be utilized in cramped work spaces, where the jointed pieces could not be arbitrarily positioned. Further, the conduit may be snaked through narrow openings or curved passageways that are otherwise practically inaccessible when rigid or jointed conduits are used, thereby allowing the transmission of hydraulic pressures of greater than about 30,000 psi even through such confined spaces. In this respect, the flexible high-pressure conduit system of the present invention provides advantageous results similar to those obtainable with rubber hoses or armored hoses, but rubber or armored hoses may be utilized only at much lower pressures, typically below about 10,000 psi. The conduit system of the present invention extends such advantages to a much higher pressure range than previously obtainable.

It will now be appreciated that, through the use of this invention, hydraulic pressures of greater than about 30,000 psi may be conveniently supplied to a mandrel through a flexible conduit system. The conduit system, including a conduit and connectors, is relatively inexpensive to fabricate and is reliable in service, since no intermediate joints or seals are required. Although a particular embodiment of the invention has been described in detail for purposes of illustration, various modifications may be made without departing from the spirit and scope of the invention. Accordingly, the invention is not to be limited except as by the appended claims.

I claim:

1. A high-pressure hydraulic tool for applying fluid pressure to apparatus, comprising:

a source of hydraulic pressure for producing a fluid pressure of at least about 30,000 psi;

adaptor means for connecting to the apparatus;

a lengthwise-flexible, hollow delivery conduit having no joints therein, and having an outer diameter of about one-eighth inch or less and an inner diameter of from about 0.01 inch to about 0.05 inch, said conduit being fabricated from a metal having a tensile strength sufficiently great that said conduit will not fail when pressurized to at least about 30,000 psi;

a first connector between one end of said conduit and said adaptor means, said first connector having first swivel means for swivelably connecting said conduit to said adaptor means;

a second connector between the other end of said conduit and said source of hydraulic pressure; and means positioned between the apparatus and said conduit, said means preventing the flow of residue from said apparatus into said conduit so that the flow of fluid in said conduit is not impeded by residue remaining in said conduit from prior pressurizations.

2. The tool of claim 1, wherein said second connector has second swivel means for swivelably connecting said conduit to said source of hydraulic pressure.

3. The tool of claim 1, wherein said first swivel means is a rotation joint whereby said conduit may rotate about its longitudinal axis at the point of the first connection.

4. The tool of claim 1, wherein said second swivel means is a rotation joint whereby said conduit may rotate about its longitudinal axis at the point of the second connection.

5. The tool of claim 1, wherein said conduit is fabricated of work-hardened 304 stainless steel.

6. The tool of claim 1, wherein said conduit has an outer diameter of about one-eighth inch and an inner diameter of about 0.04 inch.

7. A high-pressure hydraulic swaging tool for applying pressure to a mandrel to expand a tube within a tube sheet, comprising:

a source of hydraulic pressure, including a pressure intensifier for producing a fluid pressure of at least about 30,000 psi;

an adaptor having means therein for detachable connection to the mandrel;

a lengthwise-flexible, thick-walled hollow delivery conduit having an outer diameter of about one-eighth inch or less and an inner diameter of from about 0.01 inch to about 0.05 inch, said conduit being fabricated of a metal having a tensile strength sufficiently great that said conduit will not fail when pressurized to at least about 30,000 psi;

a first connector between said conduit and said adaptor, said first connector having first swivel means for allowing relative movement with at least one degree of freedom between said conduit and said adaptor;

a second connector between said conduit and said source of hydraulic pressure; and a filter in said first connector, said filter being disposed so that fluid flowing from said mandrel through said first connector is filtered to remove residue, thereby preventing the flow of residue from the mandrel into said conduit.

8. The tool of claim 7, wherein said conduit is fabricated of work-hardened 304 stainless steel.

9. The tool of claim 7, wherein said conduit has an outer diameter of about one-eighth inch and an inner diameter of about 0.04 inch.

10. For use in a high-pressure swaging apparatus for applying pressure to a mandrel to expand a tube within a tube sheet, the swaging apparatus including a source of hydraulic pressure for producing a fluid pressure of at least about 30,000 psi, and an adaptor for detachable connection to the mandrel, a conduit system for delivering fluid from the source of hydraulic pressure to the adaptor, comprising:

a lengthwise-flexible, thick-walled hollow delivery conduit having no joints therein, said conduit having an outer diameter of about one-eighth inch or less and an inner diameter of from about 0.01 inch to about 0.05 inch, said conduit being fabricated from a metal having a tensile strength sufficiently great that said conduit will not fail when pressurized to at least about 30,000 psi;

a first connector between said conduit and the adaptor, said first connector including first rotational means for allowing rotation of said conduit about its longitudinal axis at the point of the first connection;

a second connector between said conduit and the source of hydraulic pressure, said second connector having second rotational means for allowing rotation of said conduit about its longitudinal axis at the point of the second connection; and a filter in said first connector, said filter being disposed so that fluid flowing from said mandrel through said first connector is filtered to remove residue, thereby preventing the flow of residue from the mandrel into said conduit.

11. The conduit system of claim 10, wherein said conduit is fabricated of work-hardened 304 stainless steel.

12. The conduit system of claim 10, wherein the outer diameter of said conduit is about one-eighth inch, and the inner diameter of said conduit is about 0.04 inch.

* * * * *